US005721484A

United States Patent [19]

Ngo et al.

[11] Patent Number: 5,721,484

[45] Date of Patent: Feb. 24, 1998

[54] POWER SUPPLY FILTER WITH ACTIVE ELEMENT ASSIST

[75] Inventors: Tuan V. Ngo, Eden Prairie; John D. Leighton, Anoka, both of Minn.

[73] Assignee: VTC, Inc., Bloomington, Minn.

[21] Appl. No.: 769,125

[22] Filed: Dec. 19, 1996

[51] Int. Cl.[6] ..... G05F 3/16

[52] U.S. Cl. ..... 323/313; 327/532

[58] Field of Search ..... 323/312, 313, 323/315; 327/530, 532, 534, 535, 538, 540

[56] References Cited

U.S. PATENT DOCUMENTS

| | | | |
|---|---|---|---|
| 3,849,677 | 11/1974 | Stacey et al. | 327/552 |
| 4,079,375 | 3/1978 | Tacussel | 342/28 |
| 5,208,719 | 5/1993 | Wei | 361/56 |
| 5,523,665 | 6/1996 | Deaver | 320/1 |
| 5,532,631 | 7/1996 | Ngo et al. | 327/110 |
| 5,596,265 | 1/1997 | Wrathall et al. | 323/315 |

*Primary Examiner*—Matthew V. Nguyen
*Attorney, Agent, or Firm*—Kinney & Lange, P.A.

[57] ABSTRACT

A power supply filter is constructed with a capacitive element and an active element coupled to a filtered node and an impedance coupled between the filtered node and a power supply node. The filtered node for carrying a filtered version of a power supply signal on the power supply node. The active element having electrical characteristics such that the addition of the active element to the power supply filter reduces the amount of capacitance needed from the capacitive element to achieve a desired pole frequency for a given voltage drop across the impedance element.

20 Claims, 4 Drawing Sheets

POWER SUPPLY FILTER WITH ACTIVE ELEMENT ASSIST

BACKGROUND OF THE INVENTION

The present invention relates to power supply filters, and in particular relates to power supply filters that are assisted by an active element to reduce the size of a capacitive element in the filter.

Electrical circuits are typically powered by power supplies which ideally provide unlimited current at a fixed voltage. In practice, power supplies do not behave ideally because of multi-frequency noise, which causes fluctuations in the power supplies' output voltage. To eliminate this noise, prior art circuits use low pass filters, which filter high frequency signals from the power supply. Signals above a certain frequency, known as the pole frequency, are blocked by the low pass filters. Signals below the pole frequency are passed by the filters.

Such low pass filters are typically created using a resistor and a capacitor. The resistor has two terminals, one connected to the power supply and one connected to the capacitor. The second terminal of the capacitor is connected to a reference voltage. The output of the low pass filter is taken from the node between the resistor and the capacitor. The low pass characteristics of the filter can be seen by examining the behavior of the capacitor at two extremes in frequency. At zero frequency, or direct current (DC), the capacitor acts as an open circuit between the reference voltage and the filter output. Thus, the filter's output is the same as the filter's input less the DC voltage drop across the resistor. At high frequency, the capacitor acts as a short circuit between the reference voltage and the filter's output. As such, high-frequency voltage changes at the filter's input are not represented at the filter's output. In other words, high frequency signals are suppressed or blocked.

The pole frequency of such filters is determined by inverting the product of the resistance and the capacitance. Thus, larger resistors and capacitors produce lower pole frequencies. However, since the resistor is between the power supply and the filter's output, a larger resistor results in a larger voltage drop across the resistor for a given current drawn from the power supply to the filter's output. Since this lowers the voltage supplied by the filter, large resistors are avoided whenever possible.

In order to avoid using large resistors, large capacitors have been used to obtain low pole frequencies. However, the capacitors have been so large that they typically cannot be built in an integrated manner with the remainder of the circuit and must remain "off-chip". Such "off-chip" devices are undesirable because they increase manufacturing costs due to the additional steps needed to combine integrated circuits with "off-chip" devices.

Thus, to achieve lower pole frequencies, low pass filters of the prior art either use larger resistors, which cause a significant drop in the filtered supply voltage, or larger capacitors, which must be implemented as "off-chip" devices.

SUMMARY OF THE INVENTION

The present invention is a power supply filter that removes high frequency noise from a power supply signal and provides a filtered signal to a filtered node. The filter includes an impedance element, a capacitive element and an active element, with the impedance element connected between the power supply and the filtered node. The capacitive element and the active element extend from the filtered node, with the active element reducing the amount of capacitance required from the capacitive element for a desired pole frequency and a desired voltage drop across the impedance.

In several embodiments of the present invention, the active element is a transistor, referred to as a filter transistor, with an emitter, base, and collector. The collector is connected to the filtered node and the base is connected to a second terminal of the capacitive element. The emitter of the filter transistor is coupled to a reference voltage.

In still further embodiments of the present invention, the filter transistor is part of a current mirror with the remainder of the current mirror constructed from a current source, two resistors, and an additional transistor. The additional transistor, identified as a mirror transistor for reference, has its base connected to one of the two resistors, its emitter connected to the emitter of the filter transistor, and its collector connected to a center node. The center node is located between the two resistors with one resistor, referred to as the mirror resistor, further connected to the base of the mirror transistor, and the other resistor, referred to as the filter resistor, further connected to the base of the filter transistor. The center node is also connected to the current source, which is connected between the center node and the power supply.

The current mirror causes current from the current source to be the mirrored into the collector current of the filter transistor. In some embodiments of the present invention, the current mirror has a gain of five causing five times the current of the current source to flow through the collector of the filter transistor. The amount of bias current created in the filter transistor by the current mirror determines the attenuation of the filter at high frequencies because it determines the high frequency resistance of the filter transistor. This resistance forms part of a voltage divider such that a decrease in the resistance increases the attenuation of the filter by causing a smaller output voltage for a given input voltage. Since increasing the bias current decreases this resistance, larger bias currents may be used to improve the attenuation of the filter.

Some embodiments of the present invention also include an output transistor which has its base coupled to the filtered node, its collector coupled to the power supply node, and its emitter coupled to an output node. The output node provides a filtered power supply signal to other circuit elements, and the output transistor acts as a high impedance current source.

Other embodiments of the present invention include a supplemental current source, which provides current to the filtered node. The supplemental current source reduces the amount of current passing through the impedance between the power supply and the filtered node and thus reduces the voltage drop across that impedance, resulting in a higher voltage at the filtered node. The supplemental current source preferably provides all of the bias current drawn by the collector of the filter transistor and preferably comprises a current mirror driven by the same current source used to bias the filter transistor. By using such a current mirror, the current provided to the filtered node more closely matches the collector current of the filter transistor, since both are based on the same current source.

In further embodiments of the present invention, the active element is a transistor with one terminal coupled to the filtered node, a second terminal coupled to the power supply node, and a third terminal coupled to an output node. Preferably this transistor is an N-channel depletion-type Metal-Oxide-Semiconductor Field-effect Transistor (MOSFET), with its gate coupled to the filtered node, its drain coupled to the power supply node, and its source coupled to the output node. In such embodiments, an impedance element is placed between the power supply node and the gate, and a capacitive element is placed between the gate and a reference voltage node.

Each filter of the present invention can be placed on a single integrated circuit because each filter can use a relatively small capacitor. Such small capacitors may be used in the filters of the present invention because the other components of the filters compensate for the small capacitance of the "on-chip" capacitors. In those embodiments where the active element is a transistor with its collector connected to the filtered node and its base connected to the second terminal of the capacitor, the size of the required capacitor is reduced because the transistor includes an internal capacitance. This internal capacitance compensates for the small "on-chip" capacitor by providing additional capacitance. Thus, in the embodiments that have such a transistor, there is no need for an external "off-chip" capacitor to obtain suitably low pole frequencies.

In those embodiments where the active element is a MOSFET with its gate connected to the filtered node, the large input impedance of the MOSFET's gate prevents current from flowing through the filter impedance connected between the power supply and the gate. In light of this, the filter impedance may be made very large without incurring a voltage drop from the power supply node to the gate of the MOSFET. Since the pole frequency is set by the product of the filter impedance and the capacitance of the capacitor, the large filter impedance in this embodiment sets a low pole frequency even though the integrated-circuit capacitor is small compared to typical "off-chip" capacitors.

In these two embodiments, the entire power supply filter is integrated on the same chip as the integrated circuit which uses the filtered supply signal. The present invention thereby overcomes the deleterious effects of external capacitors found in the prior art. In addition, the voltage drop across the filter's impedance is minimized in order to maximize the DC voltage of the filtered supply signal.

DETAILED DESCRIPTION OF THE PREFERRED EMBODIMENTS

Figure 1:
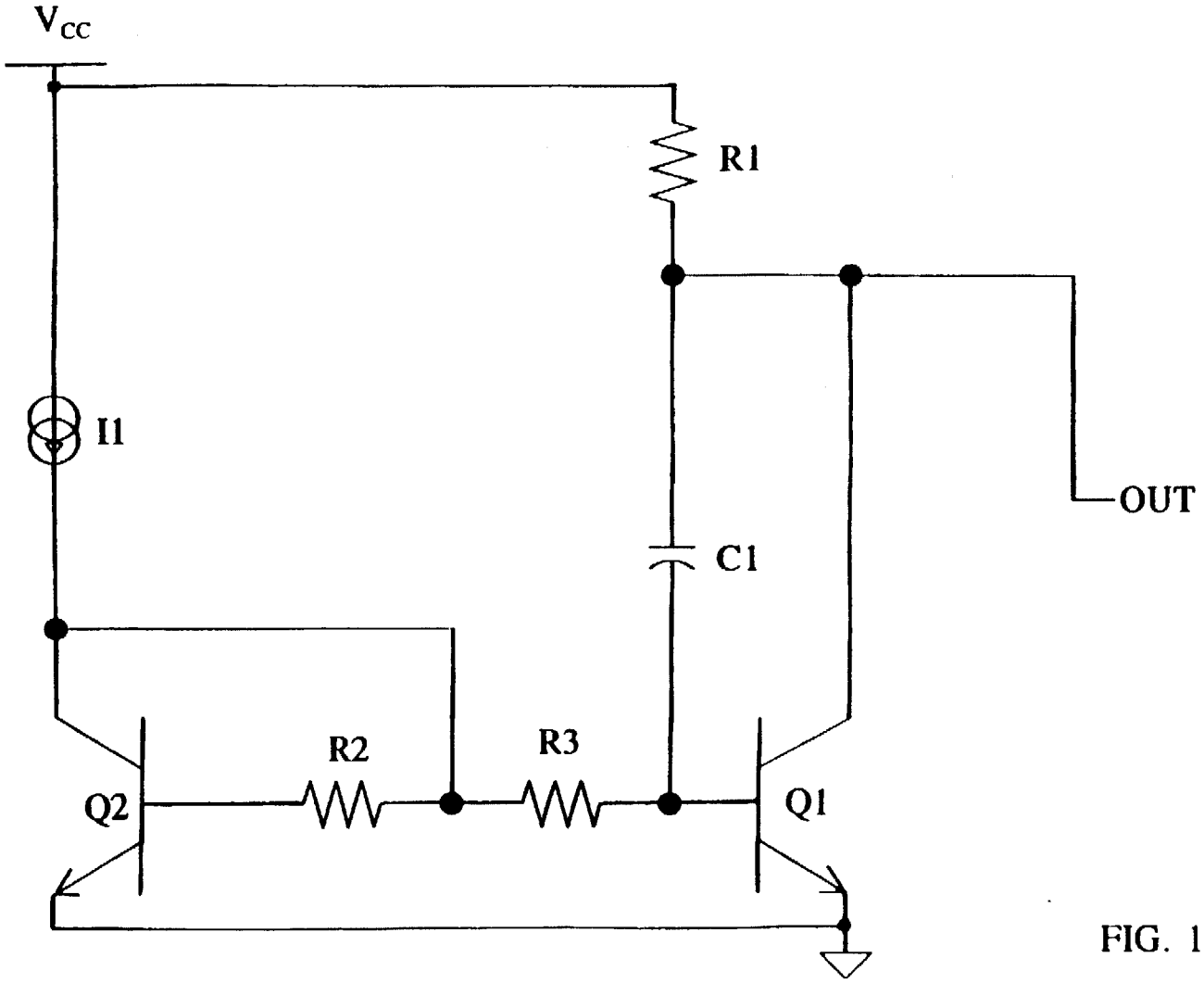
FIG. 1 is a diagram of a first embodiment of the present invention.

FIG. 1 shows a first embodiment of the power supply filter of the present invention. The basic filter is constructed from resistor R1, capacitor C1 and transistor Q1, which operate together to filter the signal at power supply node $V_{CC}$ to produce a filtered power supply signal at a filtered node OUT. The filtered power supply signal is received by other circuit components, which use it as their power supply.

In FIG. 1, resistor R1 is connected between power supply node $V_{CC}$ and filtered node OUT. Transistor Q1 has its collector connected to the filtered node and its emitter connected to a reference voltage, typically ground. Capacitor C1 is connected between the filtered node and the base of transistor Q1, providing a feedback loop for transistor Q1. Within transistor Q1 is a reverse biased P-N junction between the transistor's base and collector. This P-N junction creates an additional capacitance in parallel with capacitor C1. Since the additional capacitance is in parallel with C1, it reduces the amount of capacitance needed from capacitor C1 to achieve a desired pole frequency.

At high frequencies, capacitor C1 and the internal capacitance of transistor Q1 act as short circuits. This results in a direct connection between the base and collector of transistor Q1. For bipolar junction transistors, such as Q1, connecting the collector directly to the base causes the transistor to operate as a diode, with the base forming the anode of the diode and the emitter forming the cathode. In this diode configuration, transistor Q1 has a high-frequency resistance that is dependent on the DC bias levels of the transistor. As those skilled in the art will recognize, this resistance, typically denoted $r_e$, is equal to $V_T/I_E$, where $V_T$ is the thermal voltage of the transistor, typically equal to 25 millivolts at room temperature, and $I_E$ is the emitter's bias current. From this relationship, it can be seen that as the emitter's bias current increases, the high-frequency resistance of transistor Q1 decreases.

In order to reduce high-frequency noise at the filtered node, the present invention relies on an attenuation created by resistor R1 and the high-frequency resistance, $r_e$, of transistor Q1. Resistor R1 and resistance $r_e$, form a voltage divider $r_e(R1+r_e)$, which divides the voltage of high-frequency signal components in power supply $V_{CC}$ to produce a filtered voltage at the filtered node. If R1 is made much larger than $r_e$, the voltage divider may be approximated as $r_e/R1$, with the attenuation increasing as $r_e/R1$ decreases. Since $r_e$ is equal to $V_T/I_E$, an increase in $I_E$ results in a decrease in $r_e$ and thus a decrease in $r_e/R1$. Since a decrease in $r_e/R1$ is the same as an increase in the attenuation of the filter, increasing the emitter's bias current increases the attenuation of the filter, thus improving the performance of the filter.

In FIG. 1, the emitter's bias current is set using a current mirror. In addition to transistor Q1, the current mirror includes resistors R2 and R3, transistor Q2, and current source I1. Current source I1 is connected between power supply $V_{CC}$ and the collector of transistor Q2. The collector of transistor Q2 is further connected to a center node between resistors R2 and R3. Resistor R3 has a second terminal connected to the base of transistor Q1, and resistor R2 has a second terminal connected to the base of transistor Q2. The emitter of transistor Q2 is connected to the same reference voltage as the emitter of transistor Q1.

In preferred embodiments, for the same base-emitter voltage across each transistor, transistor Q1 conducts a collector current that is five times as large as transistor Q2. In this preferred embodiment, resistor R2 is five times the size of resistor R3, typically having values of 5 KΩ and 1 KΩ respectively. In this preferred configuration, the DC current provided by current source I1 is reflected into the collector current of transistor Q1 at a gain of five. Thus, the emitter current of transistor Q1 is approximately five times the current from current source I1. By using a current mirror with a gain of five, the present invention is able to obtain a high emitter bias current and thereby obtain a large attenuation at high frequencies.

All of the elements shown in FIG. 1 can be integrated within the same integrated circuit as the elements which use the filtered node as their power supply. In particular, capacitor C1 can be integrated into the circuit because it only needs to provide 50 picofarads of capacitance in order to achieve a sufficiently low pole frequency.

In FIG. 1, the filtered node is connected directly to the remainder of the circuit elements so that current drawn by those elements passes through resistor R1. In certain applications, this is undesirable since the current drawn through resistor R1 causes a voltage drop across resistor R1, lowering the voltage supplied to the circuit elements. To minimize this voltage drop, resistor R1 can be made smaller. However, any decrease in the resistance of resistor R1 causes a reduction in the attenuation of the filter. Thus, selecting the value of resistor R1 involves balancing design goals and those skilled in the art will recognize that the value of R1 can be chosen to optimize particular performance characteristics.

Figure 2:
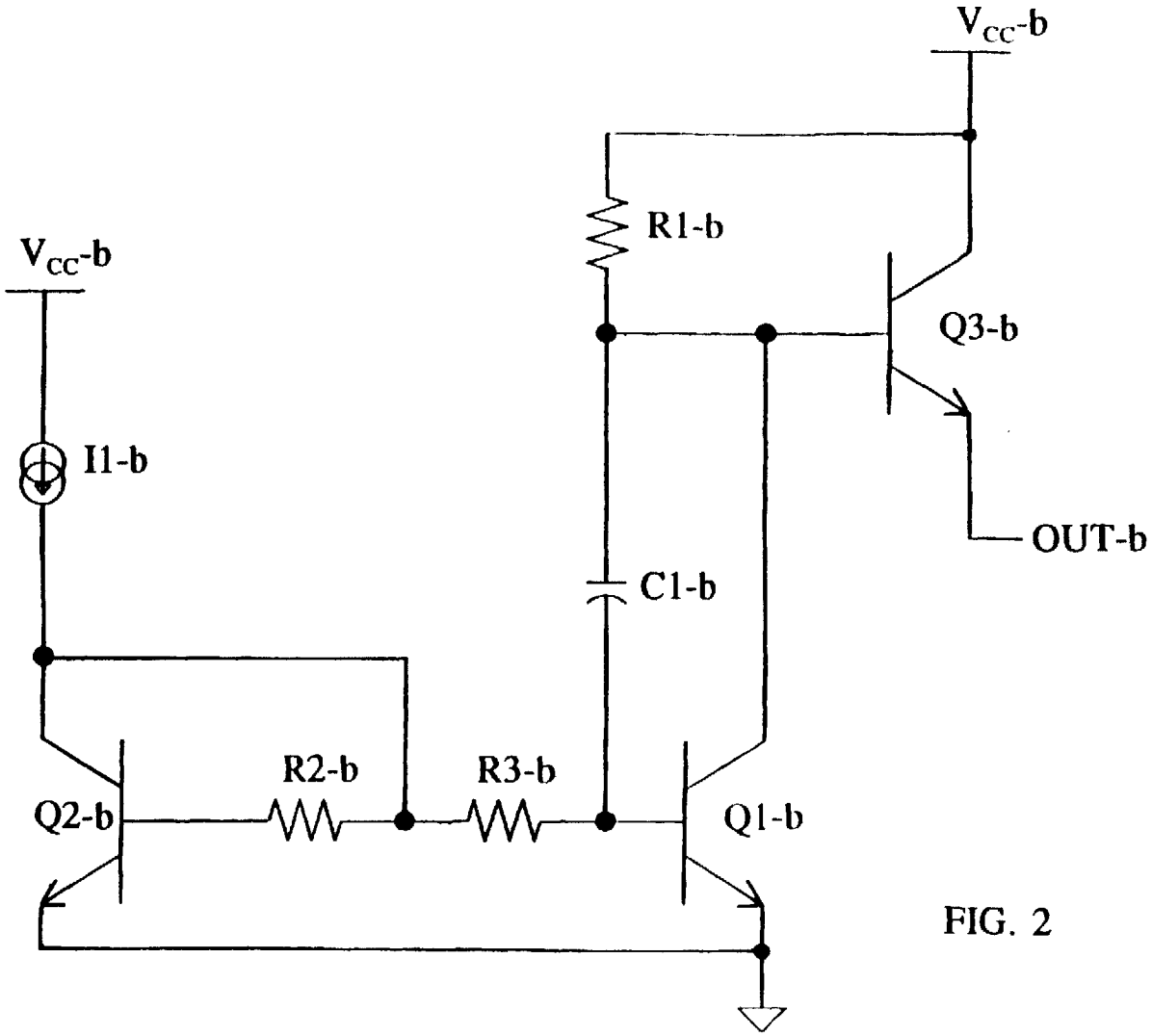
FIG. 2 is a diagram of a second embodiment of the present invention.

FIG. 2 shows a second embodiment of the present invention that is identical to the first embodiment except for the addition of transistor Q3-*b*. The elements common to both embodiments are similarly numbered in FIGS. 1 and 2 with the addition of "-*b*" to the reference characters of FIG. 2. The filter of FIG. 2 operates in an identical manner to the filter of FIG. 1 except that, in FIG. 2, most of the filter's output current passes through the collector and emitter of transistor Q3-*b* instead of through resistor R1-*b*.

Transistor Q3-*b* is configured as an emitter-follower with its emitter voltage generally tracking its base voltage. Since transistor Q3-*b* provides most of the current for the external circuit, less current passes through resistor R1-*b*. With less current passing through it, resistor R1-*b* may be larger than in the embodiment of FIG. 1 without lowering the voltage of the filtered power supply. Since the resistance of resistor R1-*b* may be increased in the embodiment of FIG. 2, the filter of FIG. 2 also has an improved filter attenuation. Although transistor Q3-*b* eliminates a large mount of the voltage drop across resistor R1-*b*, some current continues to flow through resistor R1-*b*, creating some voltage drop across the resistor. In addition, transistor Q3-*b* includes its own base-emitter voltage drop of approximately 0.7 volts.

Figure 3:
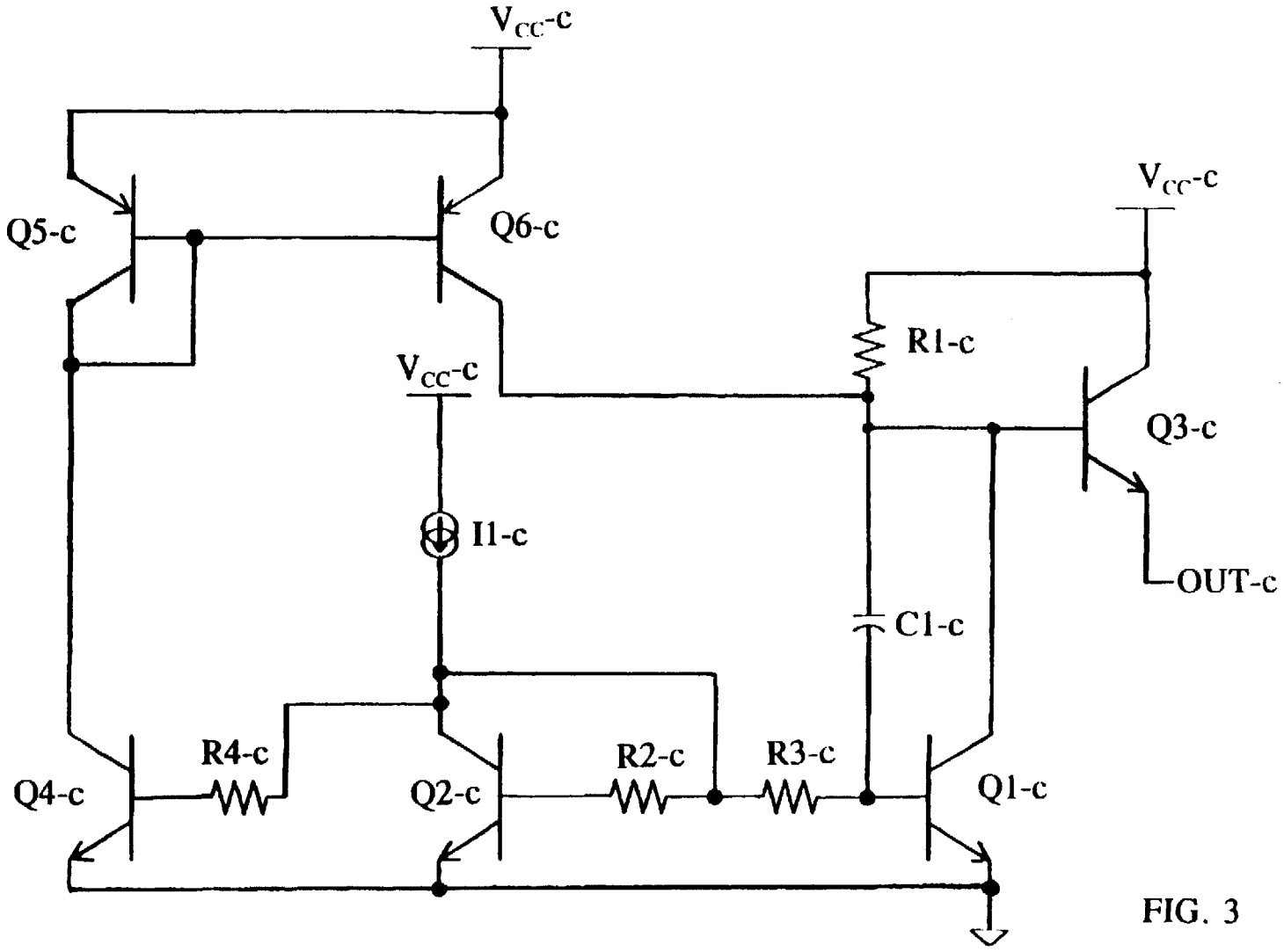
FIG. 3 is a diagram of a third embodiment of the present invention.

FIG. 3 shows a third embodiment of the present invention that has all of the components of the embodiment of FIG. 2, marked with the same representative characters as in FIG. 2, except replacing "-*b*" at the end of each reference character with "-*c*". In addition, the embodiment of FIG. 3 includes a supplemental current source which provides current to the filtered node to further reduce the level of DC current passing through resistor R1-*c*.

In the embodiment of FIG. 3, the supplemental current source is constructed from a current mirror. The current mirror includes current source I1-*c*, resistors R2-*c* and R4-*c*, and transistors Q2-*c*, Q4-*c*, Q5-*c*, and Q6-*c*. Thus, this current mirror shares current source I1-*c*, transistor Q2-*c* and resistor R2-*c* with the current mirror used to bias transistor Q1-*c*. A first terminal of resistor R4-*c* is connected to: the collector of transistor Q2-*c*, one terminal of resistor R2-*c*, and current source I1-*c*. The second terminal of resistor R4-*c* is connected to the base of transistor Q4-*c*, which has its emitter connected to a reference voltage and its collector connected to the base and collector of PNP transistor Q5-*c*. The base of transistor Q5-*c* is further connected to the base of PNP transistor Q6-*c*. Transistors Q5-*c* and Q6-*c* have their emitters connected to power supply $V_{CC}$-c, and the collector of transistor Q6-*c* is connected to the filtered node at the collector of transistor Q1-*c*.

In preferred embodiments, transistor Q4-*c* produces five times the collector current of transistor Q2-*c* for a given base-emitter voltage across the two transistors. In addition, resistor R2-*c* preferably has five times the resistance of resistor R4-*c*. With this configuration, the collector current of transistor Q4-*c* is five times the collector current of transistor Q2-*c*, or approximately five times the DC current provided by current source I1-*c*.

Transistors Q5-*c* an Q6-*c* are preferably identical PNP devices that reflect the collector current of transistor Q4-*c* to the collector of transistor Q6-*c*. Thus, the collector current of transistor Q6-*c* is ideally five times the collector current of transistor Q2-*c*.

As discussed in reference to FIG. 1 above, transistor Q1-*c* has a collector current that is preferably five times the collector current of transistor Q2-*c*. Thus, the collector current of transistor Q6-*c* ideally matches the collector current of transistor Q1-*c*, and thereby provides all of the needed bias current for transistor Q1-*c*. This reduces the level of bias current passing through resistor R1-*c* and thus reduces the voltage drop across resistor R1-*c*. In fact, in this embodiment, the only current passing through resistor R1-*c* is the base current of transistor Q3-*c*.

In the embodiment of FIG. 3, resistor R1-*c* is typically chosen to provide a 0.4 volt drop from the power supply node $V_{CC}$ to the filtered node at the expected current levels of the external circuit. With the 0.7 volt drop across the base-emitter junction of transistor Q3-*c*, this results in a total voltage drop of 1.1 volts from the power supply node $V_{CC}$-c to output OUT-c.

Although not shown, it is possible to increase transistor Q6-*c*'s collector current so that it exceeds the bias collector current of transistor Q1-*c*. If transistor Q6-*c*'s collector current is increased, less current flows through resistor R1-*c* to the base of transistor Q3-*c*. In such embodiments, transistor Q6-*c* can provide both the collector current of transistor Q1-*c* and the base current of transistor Q3-*c*. With less current passing through resistor R1-*c*, the resistance of resistor R1-*c* can be increased in such embodiments and may even be made infinite by removing the resistor and leaving an open circuit in its place.

Figure 4:
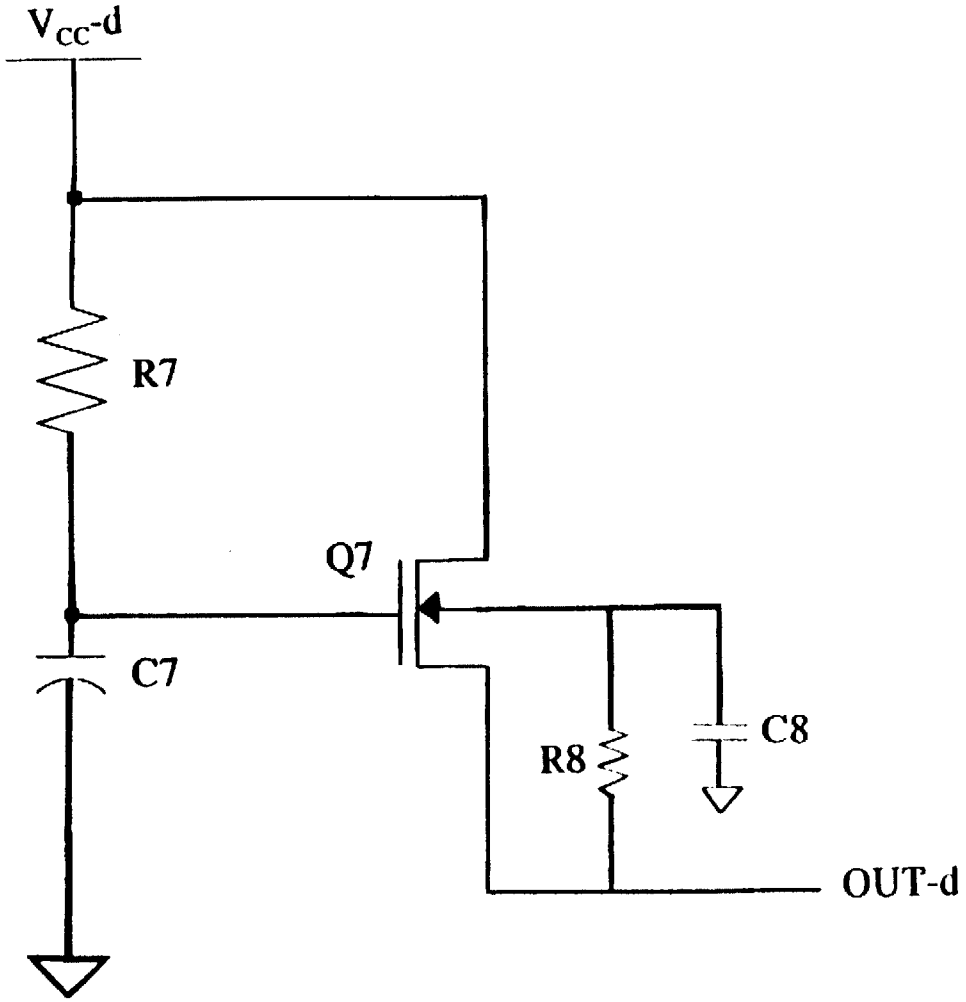
FIG. 4 is a diagram of a fourth embodiment of the present invention.

FIG. 4 shows a fourth embodiment of the present invention which provides an RC filter coupled to an output stage MOSFET Q7. The RC filter is formed by a resistor R7 and a capacitor C7, with the pole frequency of the filter determined by inverting the product of their respective resistance and capacitance. Resistor R7 has a first terminal connected to power supply $V_{CC}$-d and a second terminal connected to a first terminal of capacitor C7. The second terminal of capacitor C7 is connected to a reference voltage, preferably ground. The node between resistor R7 and capacitor C7 is further connected to the gate of MOSFET Q7, which has its drain connected to power supply $V_{CC}$-d and its source connected to an output node OUT-d. The output node provides a filtered power supply to other circuit elements (not shown).

Transistor Q7 is preferably an N-channel MOSFET which has an almost infinite input impedance at its gate. This infinite input impedance, combined with the infinite DC impedance of capacitor C7, prevents a DC current from flowing through resistor R7. Therefore, the voltage at the gate of transistor Q7 is equal to the voltage of power supply $V_{CC}$-d. Since there is no voltage drop across resistor R7, resistor R7 can be made very large without decreasing the voltage at OUT-d.

Since the pole frequency of the filter is determined by inverting the product of R7's resistance and C7's capacitance, a larger resistance for R7 can lower the pole frequency of the filter or can reduce the mount of capacitance needed from capacitor C7 to achieve a desired pole frequency. In the present invention, it is preferred that the capacitance of C7 be reduced because reducing the required capacitance reduces the physical size of capacitor C7. In fact, it is preferred that resistor R7's resistance be selected so that capacitor C7 may be made small enough to integrate "on-chip" with the remainder of the circuit elements, thereby eliminating the problems associated with using external capacitors in power supply filters.

Transistor Q7, like all MOSFETs, is a four terminal device with the fourth terminal connected to the body of the device. The body is preferably biased so that its bias voltage matches the bias voltage of the source. This is accomplished in FIG. 4 by connecting resistor R8 between the body terminal and the source.

The connection between the body and the source results in a reverse biased drain-to-body junction. This junction has a junction capacitance that can affect the operation of the filter. Specifically, this capacitance acts as a short circuit at high frequencies and when combined with the conductive pathway through resistor R8 can act as a direct link between power supply $V_{CC}$-d and output OUT-d. Such a direct link would bypass the filtering effects of resistor R7 and capacitor C7, and thus, at high frequencies, the RC filter would no longer be effective.

To avoid bypassing the filter at high frequencies, the embodiment of FIG. 4 has an additional capacitor, C8, which is connected between the body and a reference voltage, preferably ground. At high frequencies, capacitor C8 shorts the body to the reference voltage, thereby preventing noise in power supply $V_{CC}$-d from affecting output OUT-d.

In all of the above embodiments, a power supply filter provides a filtered power supply signal using an impedance, a capacitor and additional circuitry to set a low pole frequency. In addition, the present invention obtains the advantages inherent with having a fully integrated filter for the power supply while maintaining a large amount of the original D.C. voltage from the unfiltered power supply.

Although the present invention has been described with reference to preferred embodiments, workers skilled in the art will recognize that changes may be made in form and detail without departing from the spirit and scope of the invention.

What is claimed is:

1. A power supply filter, for filtering a power supply signal, the power supply filter comprising:

a power supply node for carrying a power supply signal from a power supply source;

an impedance element having a first terminal coupled to the power supply node and a second terminal coupled to a filtered node, the filtered node for carrying a filtered version of the power supply signal;

a capacitive element, having a first terminal coupled to the filtered node, the capacitive element and the impedance element producing a filtered version of the power supply signal; and an active element coupled to the filtered node, the active element having electrical characteristics such that the addition of the active element to the power supply filter reduces the amount of capacitance needed from the capacitive element to achieve a desired pole frequency for a given voltage drop across the impedance element.

2. The power supply filter of claim 1 wherein the active element is a filter transistor with a collector coupled to the filtered node, a base coupled to a second terminal of the capacitive element, and an emitter coupled to a reference voltage node.

3. The power supply filter of claim 2 wherein the filter transistor is part of a current mirror, the remainder of the current mirror comprising:

a filter resistor, coupled between the base of the filter transistor and a center node;

a mirror current source, coupled between the power supply node and the center node;

a mirror transistor having a base, emitter and collector, the collector coupled to the center node and the emitter coupled to the emitter of the filter transistor; and a mirror resistor, coupled between the center node and the base of the mirror transistor.

4. The power supply filter of claim 3 wherein the filter transistor has a filter collector current dependent on a base-emitter voltage between the base and emitter of the filter transistor and the mirror transistor has a mirror collector current dependent on the base-emitter voltage between the base and emitter of the mirror transistor, the magnitude of the filter collector current five times the magnitude of the mirror collector current when the same base-emitter voltage is applied to both the filter transistor and the mirror transistor.

5. The power supply filter of claim 2 further comprising an output transistor having a base, collector and emitter, the base of the output transistor coupled to the filtered node, the collector of the output transistor coupled to the power supply node, and the emitter of the output transistor coupled to an output node, the output node for providing a filtered power supply signal to other circuit elements.

6. The power supply filter of claim 2 further comprising a supplemental current source coupled to the filtered node.

7. The power supply filter of claim 6 wherein the filter transistor has a filter collector current dependent on a voltage between its base and emitter and wherein the supplemental current source provides a current to the filtered node such that the provided current nearly matches the filter collector current.

8. The power supply filter of claim 7 wherein the filter transistor is part of a current mirror, the remainder of the current mirror comprising:

a filter resistor, coupled between the base of the filter transistor and a center node;

a mirror current source, coupled between the power supply node and the center node;

a mirror transistor having a base, emitter and collector, the collector coupled to the center node and the emitter coupled to the emitter of the filter transistor; and a mirror resistor, coupled between the center node and the base of the mirror transistor.

9. The power supply filter of claim 8 wherein the supplemental current source is a current mirror comprising:

a reflective resistor, having one terminal coupled to the mirror current source;

a first reflective transistor, the first reflective transistor having a collector, emitter and base, the base coupled to the reflective resistor and the emitter coupled to the emitter of the filter transistor;

a second reflective transistor, having a base and collector coupled to the collector of the first reflective transistor and having an emitter coupled to the power supply node; and a third reflective transistor, having a base coupled to the base and collector of the second reflective transistor, an emitter coupled to the power supply node, and a collector coupled to the filtered node.

10. The power supply of claim 9 further comprising an output transistor having a base, collector and emitter, the base of the output transistor coupled to the filtered node, the collector of the output transistor coupled to the power supply node, and the emitter of the output transistor coupled to an output node, the output node for providing a filtered power supply signal to other circuit elements.

11. The power supply of claim 3 further comprising an output transistor having a base, collector, and emitter, the base of the output transistor coupled to the filtered node, the collector of the output transistor coupled to the power supply node, and the emitter of the output transistor coupled to an output node, the output node for providing a filtered power supply signal to other circuit elements.

12. The power supply filter of claim 1 wherein the active element is a transistor with a first terminal coupled to the power supply node, a second terminal coupled to the filtered node and a third terminal coupled to an output node, the output node for providing a filtered power supply signal to other circuit elements.

13. The power supply filter of claim 12 wherein the transistor is a metal-oxide-semiconductor field-effect transistor.

14. A power supply filter for filtering a power supply signal to produce a filtered power supply signal, the power supply filter comprising:

a power supply node for receiving the power supply signal;

a first filter element having: an impedance, a first terminal connected to the power supply node and a second terminal connected to a filtered node;

a second filter element having: a capacitance, a first terminal connected to the filtered node and a second terminal connected to a base node; and a third filter element, the third filter element acting as an active element and having a first terminal connected to the filtered node, a second terminal connected to the base node and a third terminal coupled to a reference node.

15. The power supply filter of claim 14 further comprising an output stage, the output stage having a first terminal coupled to the power supply node, a second terminal coupled to the filtered node, and a third terminal coupled to an output node, the output node carrying the filtered power supply signal.

16. The power supply filter of claim 14 further comprising a current source, coupled to the filtered node, for providing current to the filtered node.

17. The power supply filter of claim 14 wherein the third filter element is part of a current mirror.

18. The power supply of claim 16 wherein the current source comprises a current mirror.

19. A power supply filter, for filtering a power supply signal to produce a filtered power supply signal, the power supply filter comprising:

a power supply node for receiving the power supply signal;

a resistor having first and second terminals, the first terminal connected to the power supply node, the second terminal connected to a gate node;

a capacitor having a first terminal coupled to the gate node and a second terminal coupled to a reference node at a reference voltage; and a transistor, comprising a first terminal coupled to the power supply node, a second terminal coupled to the gate node, and a third terminal coupled to an output node, the output node carrying the filtered power supply signal.

20. The power supply filter of claim 19 wherein the transistor is a metal-oxide-semiconductor field-effect transistor.

* * * * *

UNITED STATES PATENT AND TRADEMARK OFFICE

CERTIFICATE OF CORRECTION

PATENT NO. : 5,721,484

DATED : FEBRUARY 24, 1998

INVENTOR(S) : TUAN V. NGO, JOHN D. LEIGHTON

It is certified that error appears in the above-indentified patent and that said Letters Patent is hereby corrected as shown below:

Col. 5, line 36, delete "mount", insert --amount--

Col. 7, line 1, delete "mount", insert --amount--

Signed and Sealed this

Twentieth Day of October, 1998

*Attest:*

Bruce Lehman

BRUCE LEHMAN

*Attesting Officer*

*Commissioner of Patents and Trademarks*